US007507168B2

(12) United States Patent
Chou et al.

(10) Patent No.: US 7,507,168 B2
(45) Date of Patent: Mar. 24, 2009

(54) GOLF CLUB HEAD

(75) Inventors: I-Nan Chou, Kaohsiung Hsien (TW); Tai-Kung Liu, Kaohsiung (TW); Chieh-Fu Tseng, Kaohsiung (TW); Chang-Horng Lai, Kaohsiung (TW); Yuan-Jen Hou, Faohsiung Hsien (TW)

(73) Assignee: Advanced International Multitech Co., Ltd., Kaohsiung (TW)

( * ) Notice: Subject to any disclaimer, the term of this patent is extended or adjusted under 35 U.S.C. 154(b) by 0 days.

(21) Appl. No.: 11/680,734

(22) Filed: Mar. 1, 2007

(65) Prior Publication Data

US 2008/0214322 A1 Sep. 4, 2008

(51) Int. Cl.
*A63B 53/04* (2006.01)

(52) U.S. Cl. ..... 473/346; 473/348; 473/349

(58) Field of Classification Search ..... 473/345–346, 473/348, 349

See application file for complete search history.

(56) References Cited

U.S. PATENT DOCUMENTS

2005/0096154 A1* 5/2005 Chen ..... 473/345
2006/0100031 A1* 5/2006 Lan ..... 473/345
2006/0270490 A1* 11/2006 Lo ..... 473/345
2008/0070721 A1* 3/2008 Chen et al. ..... 473/346

* cited by examiner

*Primary Examiner*—Stephen L. Blau
(74) *Attorney, Agent, or Firm*—Stephen A. Bent; Foley & Lardner LLP

(57) ABSTRACT

A golf club head includes a hollow head body, a metal plate, and a compression resistant plate. The hollow head body is formed with an opening. The metal plate is fixed to the hollow head body, covers the opening, and has a thickness ranging from 0.1 to 0.5 mm. The compression resistant plate is bonded to an inner surface of the metal plate and spans the opening.

9 Claims, 11 Drawing Sheets

GOLF CLUB HEAD

BACKGROUND OF THE INVENTION

1. Field of the Invention

The invention relates to a golf club head, more particularly to a golf club head, the center of gravity of which is lowered.

2. Description of the Related Art

The weight distribution of a golf club head may affect transitional equilibrium and side spin effect of the golf club head and the flying state of the stricken golf ball. If the gravity center of the golf club head is relatively high, the trajectory of the stricken golf ball is relatively low, and the back spin of the stricken golf ball is relatively high. It is difficult to strike a high flying golf ball using such a golf club head. Therefore, such a golf club head is suitable for a golf player having a strong striking power. Oppositely, if the gravity center of the golf club head is relatively low, the trajectory of the stricken golf ball is relatively high, and the back spin of the stricken golf ball is relatively low. Therefore, such a golf club head is suitable for a golf player having a weak striking power. Additionally, if the gravity center of the golf club head is too close to the striking plate of the golf club head, the golf club head will experience severe side spin when striking a golf ball, which may affect oscillation equilibrium of the golf club head.

Conventionally, one of the methods for the weight distribution design of a golf club head is to anchor or lock a counterweight member to a head body of the golf club head so as to change the gravity center of the golf club head. Another one of the methods for the weight distribution design of a golf club head is to reduce the thickness of the top or side portion of the head body of the gold club head by casting or by brazing.

When the golf club head having a thin wall is produced by casting, the wall of the golf club head has a thickness larger than 0.6 mm. The center of gravity of the golf club head ranges from 18 to 21 mm relative to the bottom of the golf club head, and thus cannot be lowered effectively. If the wall of the golf club head is polished so as to further reduce the thickness thereof, the thickness of the wall of the golf club head maybe uneven, and the mechanical strength of the golf club head may be insufficient as well.

When the golf club head is produced by brazing a metal plate to a head body, the metal plate used conventionally has a thickness larger than 0.55 mm. However, the compression resistance and the impact resistance of the metal plate are insufficient, and thus, the metal plate is liable to deform. Furthermore, the solder used for the brazing has a relatively high specific gravity, which will increase the center of gravity of the golf club head produced thereby. Therefore, the center of gravity of the golf club head produced by brazing is still in a range from 18 to 21 mm relative to the bottom of the golf club head.

SUMMARY OF THE INVENTION

Therefore, the object of the present invention is to provide a golf club head, the center of gravity of which is lowered effectively.

Accordingly, the golf club head of this invention includes a hollow head body, a metal plate, and a compression resistant plate. The hollow head body is formed with an opening. The metal plate is fixed to the hollow head body, covers the opening, and has a thickness ranging from 0.1 to 0.5 mm. The compression resistant plate is bonded to an inner surface of the metal plate and spans the opening.

BRIEF DESCRIPTION OF THE DRAWINGS

Other features and advantages of the present invention will become apparent in the following detailed description of the preferred embodiments with reference to the accompanying drawings, of which:

FIG. 2-1 is a fragmentary sectional view of the first preferred embodiment;

FIG. 2-2 is a schematic view of the first preferred embodiment;

FIG. 3-1 is a fragmentary sectional view of a second preferred embodiment of a golf club head according to this invention;

FIG. 3-2 is a schematic view of the second preferred embodiment;

FIG. 4-1 is a fragmentary sectional view of a third preferred embodiment of a golf club head according to this invention;

FIG. 4-2 is a schematic view of the third preferred embodiment;

FIG. 5-1 is a fragmentary sectional view of a fourth preferred embodiment of a golf club head according to this invention;

FIG. 5-2 is a schematic view of the fourth preferred embodiment;

FIG. 6-1 is a fragmentary sectional view of a fifth preferred embodiment of a golf club head according to this invention;

FIG. 6-2 is a schematic view of the fifth preferred embodiment;

FIG. 7-1 is a fragmentary sectional view of a sixth preferred embodiment of a golf club head according to this invention;

FIG. 7-2 is a schematic view of the sixth preferred embodiment;

FIG. 8-1 is a fragmentary sectional view of a seventh preferred embodiment of a golf club head according to this invention;

FIG. 8-2 is a schematic view of the seventh preferred embodiment;

FIG. 9-1 is a fragmentary sectional view of an eighth preferred embodiment of a golf club head according to this invention;

FIG. 9-2 is a schematic view of the eighth preferred embodiment;

FIG. 10-1 is a fragmentary sectional view of a ninth preferred embodiment of a golf club head according to this invention;

FIG. 10-2 is a schematic view of the ninth preferred embodiment;

DETAILED DESCRIPTION OF THE PREFERRED EMBODIMENTS

Figure 1:
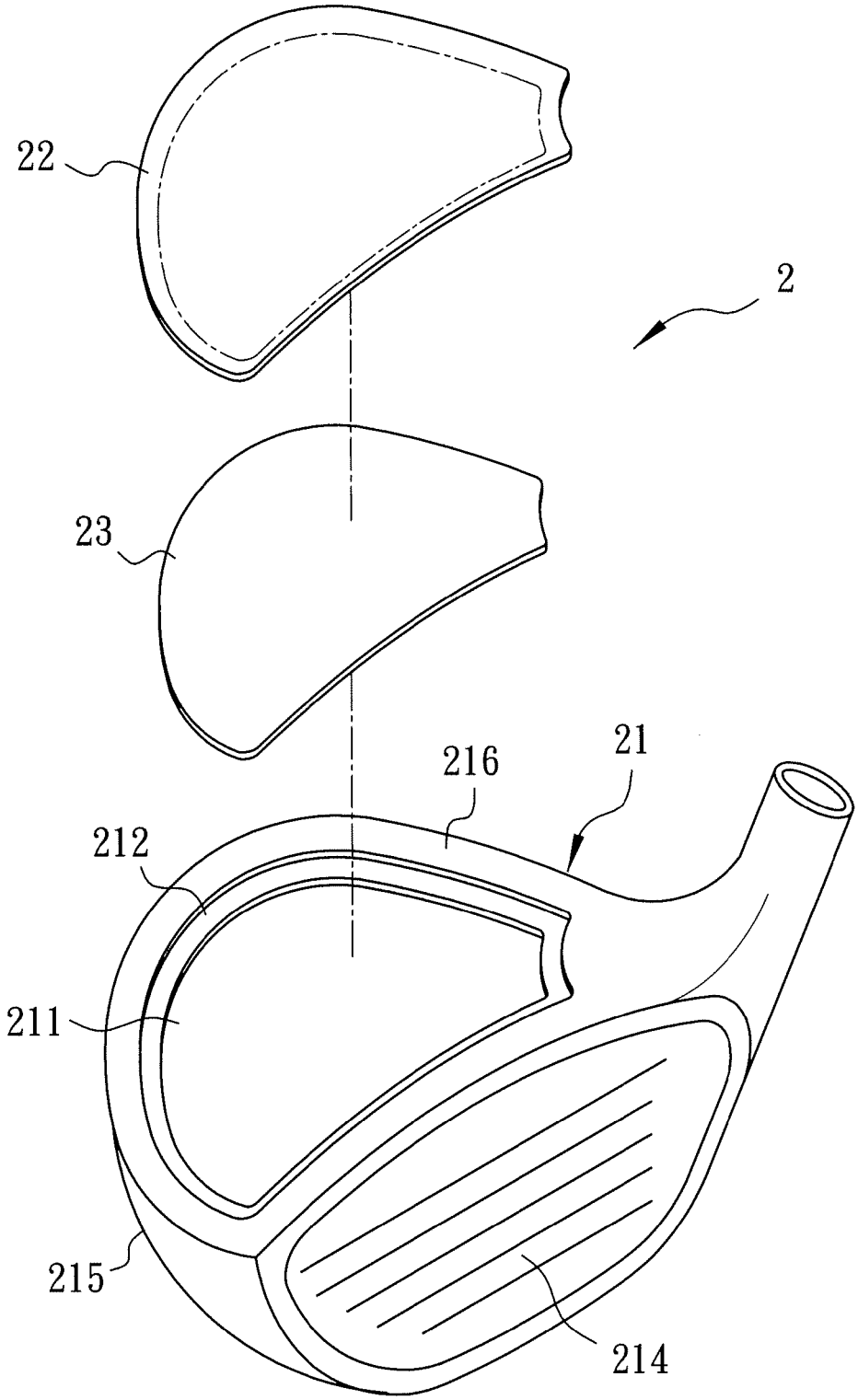
FIG. 1 is an exploded perspective view of a first preferred embodiment of a golf club head according to this invention.

Before the present invention is described in greater detail, it should be noted that like elements are denoted by the same reference numerals throughout the disclosure.

Figures 1, 2:
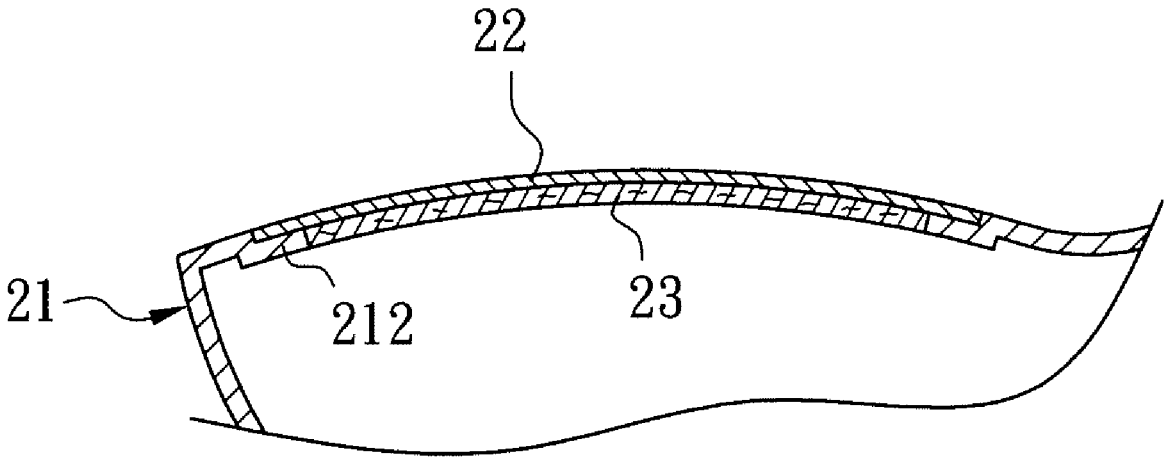
Figure 2:
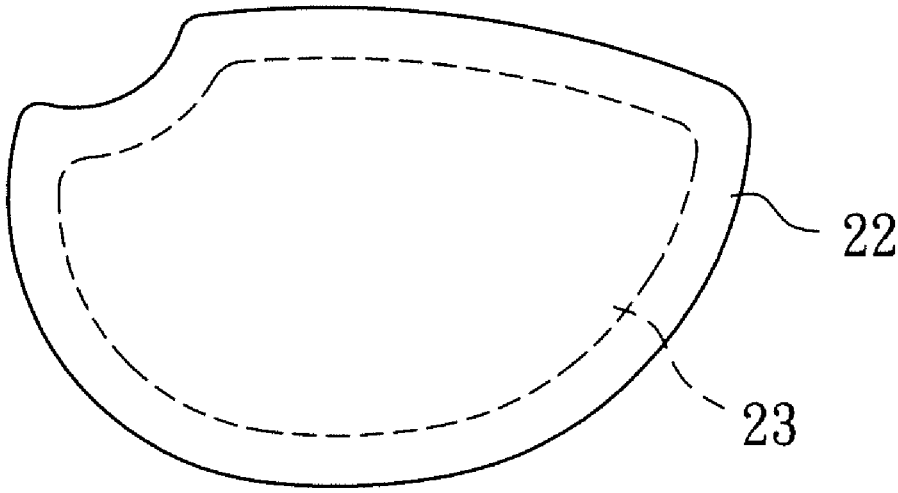

Referring to FIGS. 1, 2-1, and 2-2, the first preferred embodiment of a golf club head 2 according to this invention is shown to include a hollow head body 21, a metal plate 22, and a compression resistant plate 23.

The hollow head body 21 has a front striking face 214, a rear side 215 opposite to the front striking face 214, a top side 216, an opening 211 formed at the top side 216, and an inner periphery 212 that defines the opening 211 and that is stepped to form a shoulder formation around the opening 211.

The metal plate 22 is formed as a separate piece from the hollow head body 21, is seated on and is fixed to the shoulder formation of the hollow head body 21, covers the opening 211, and has a thickness ranging from 0.1 to 0.5 mm. In the preferred embodiment, the metal plate 22 has a thickness smaller than that of a wall of the hollow head body 21. The metal plate 22 can be glued, brazed, or resistance-welded to the shoulder formation of the hollow head body 21. In this preferred embodiment, the metal plate 22 is glued to the shoulder formation of the hollow head body 21 using a gluing agent of low specific gravity. The metal plate 22 is made of a titanium alloy, an aluminum alloy, a magnesium alloy, or a stainless steel. In this preferred embodiment, the metal plate 22 is made of a titanium alloy.

The compression resistant plate 23 is bonded to an inner surface of the metal plate 22 by gluing and spans the opening 211. In this preferred embodiment, the compression resistant plate 23 has a shape corresponding to that of the opening 211, and is fitted in the opening 211. The compression resistant plate 23 has a specific gravity less than that of the hollow head body 21. In the preferred embodiment, the specific gravity of the compression resistant plate 23 is less than 2.8, and is made of a carbon fiber composite material, a glass fiber composite material, a boron fiber composite material, a short fiber thermoplastic composite material, a titanium fiber composite material, a titanium mesh composite material, an aluminum alloy, or a magnesium alloy. In this preferred embodiment, the compression resistant plate 23 is made of a carbon fiber composite material.

In view of the aforesaid, the golf club head 2 of this invention has the following advantages:

1) The center of gravity of the golf club head 2 of the present invention can be lowered to a range from 8 to 18 mm relative to the bottom of the golf club head 2 by fixing the metal plate 22 having a thickness ranging from 0.1 to 0.5 mm to the hollow head body 21. Therefore, a golf ball stricken by the golf club head 2 can have a high trajectory and a low back spin and can fly stably as a high flying ball.

2) The compression resistant plate 23 having a specific gravity less than 2.8 is bonded to the inner surface of the metal plate 22. The mechanical properties such as compression resistance, impact resistance, and structural rigidity of the golf club head 2 of the present invention are improved. Therefore, the deformation problem suffered in the prior art can be avoided while lowering the center of gravity of the golf club head 2. Additionally, the striking sound produced by the golf club head 2 is relatively crisp.

Figures 1, 3:
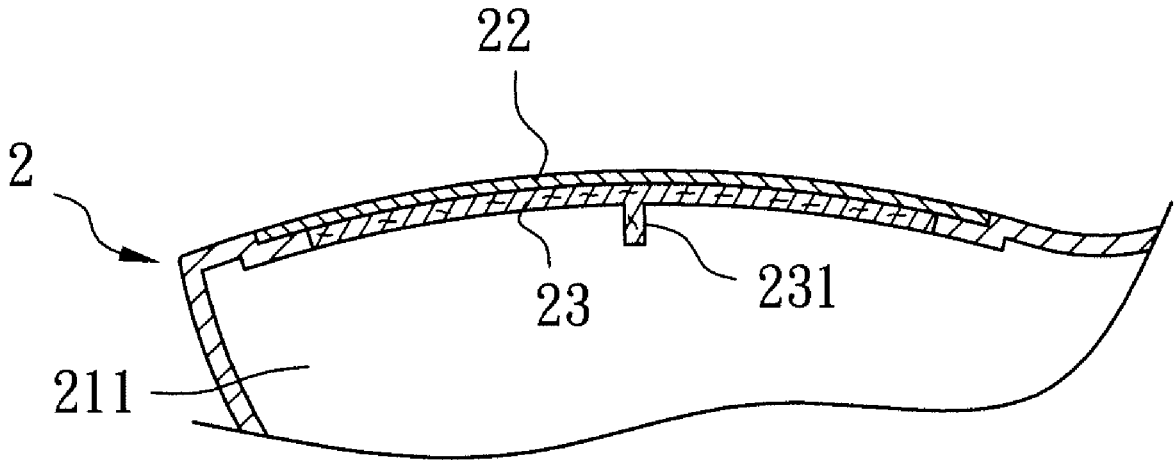
Figures 2, 3:
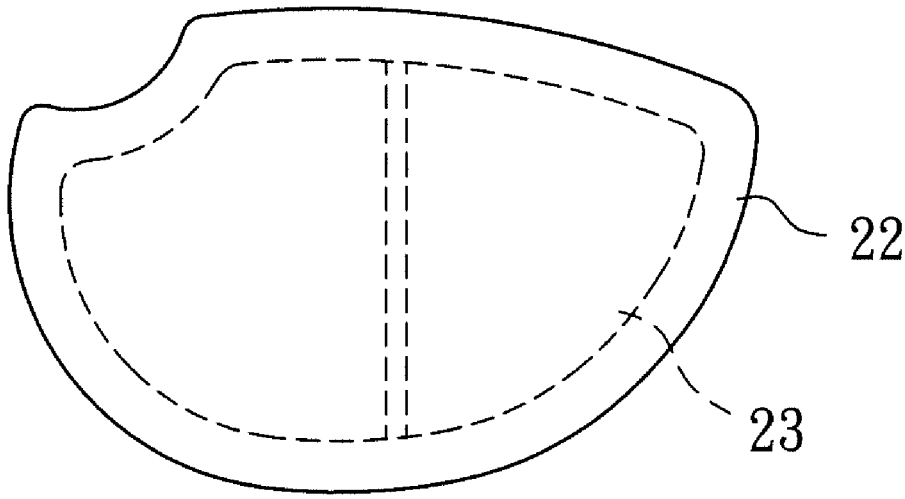

Referring to FIGS. 3-1 and 3-2, the second preferred embodiment of a golf club head 2 according to this invention is shown to be similar to the first preferred embodiment except that the compression resistant plate 23 includes a rib 231 projecting inwardly from the middle thereof and spanning the opening 211.

Figures 1, 4:
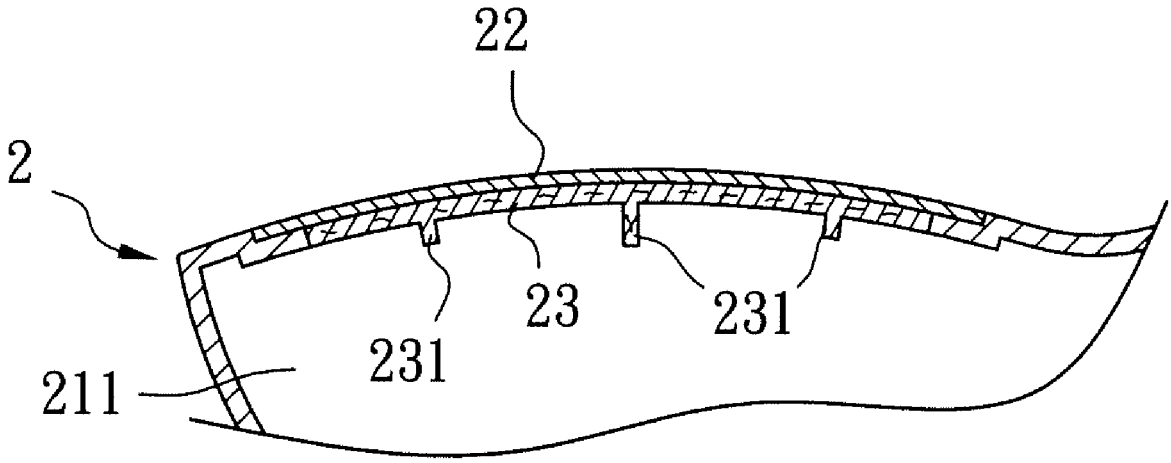
Figures 2, 4:
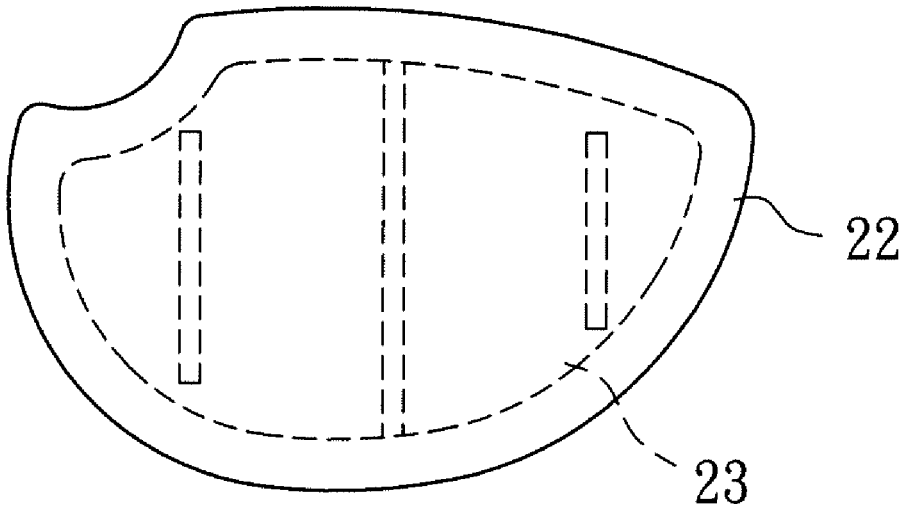

Referring to FIGS. 4-1 and 4-2, the third preferred embodiment of a golf club head 2 according to this invention is shown to be similar to the first preferred embodiment except that the compression resistant plate 23 includes a plurality of ribs 231 projecting inwardly from the compression resistant plate 23, being substantially parallel to each other, and spanning the opening 211.

Figures 1, 5:
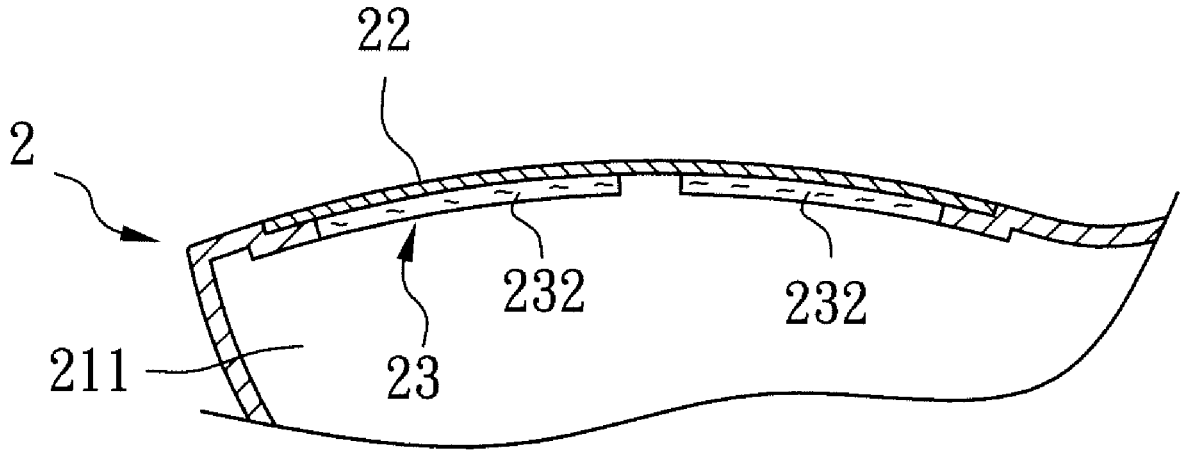
Figures 2, 5:
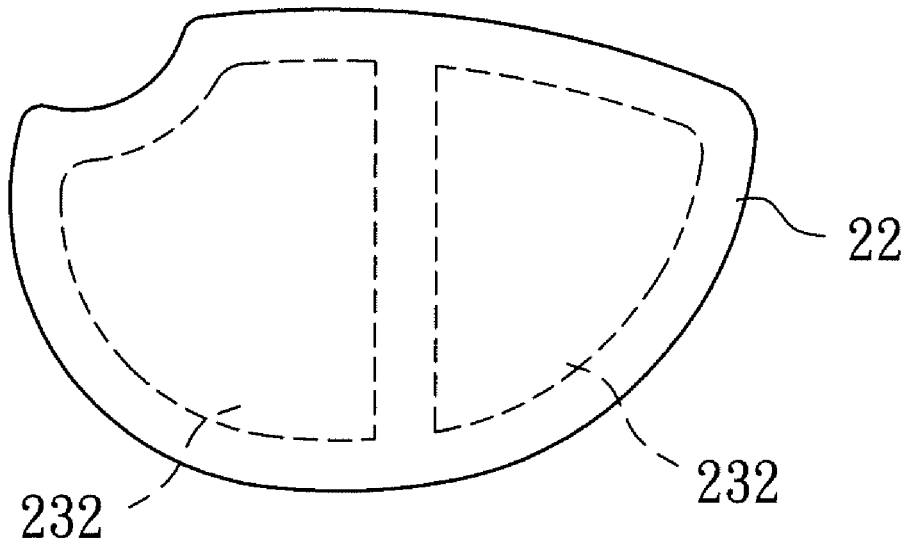

Referring to FIGS. 5-1 and 5-2, the fourth preferred embodiment of a golf club head 2 according to this invention is shown to be similar to the first preferred embodiment except that the compression resistant plate 23 includes two compression resistant plate portions 232 spaced apart from each other, glued to the inner surface of the metal plate 22, and spanning the opening 211.

Figures 1, 6:
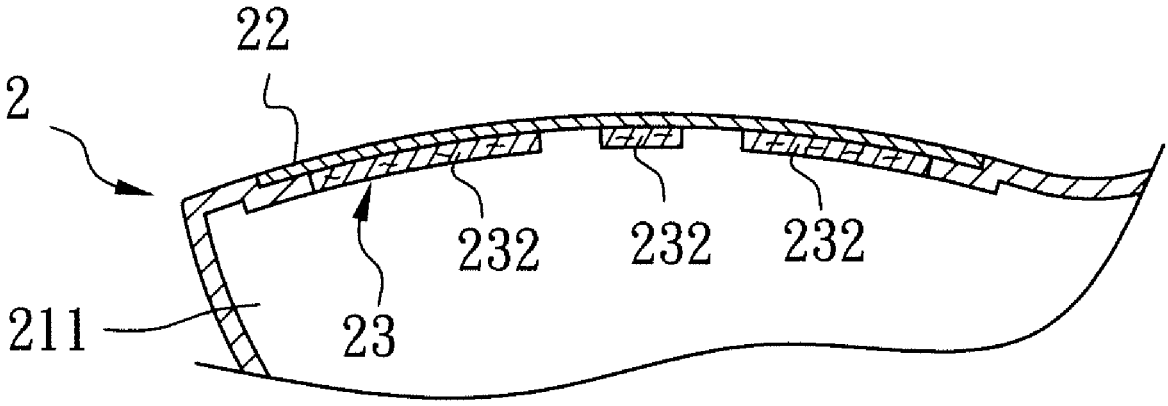
Figures 2, 6:
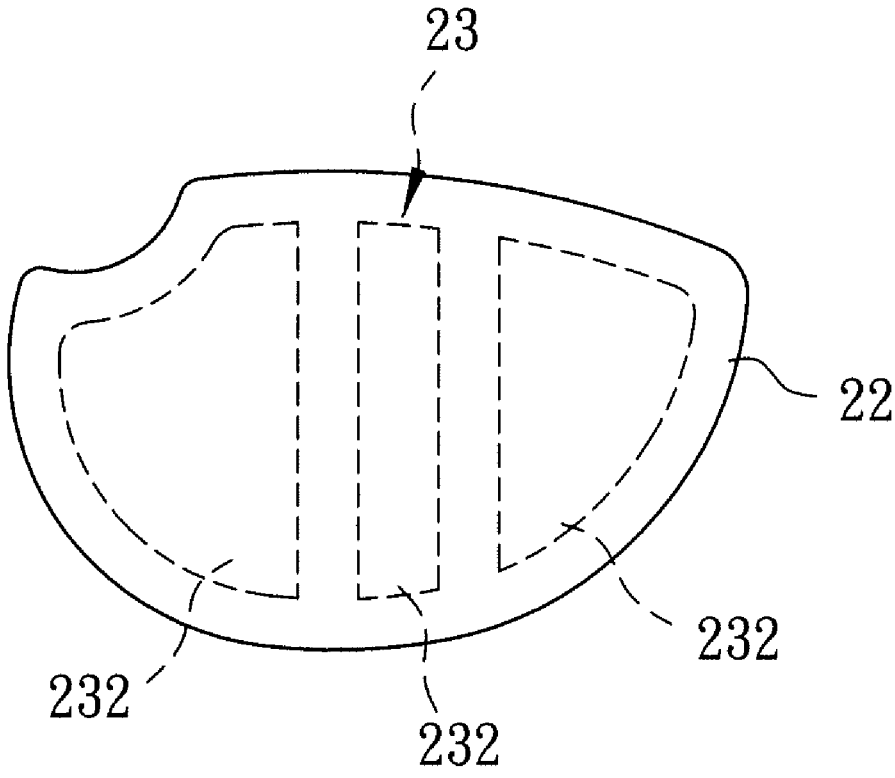

Referring to FIGS. 6-1 and 6-2, the fifth preferred embodiment of a golf club head 2 according to this invention is shown to be similar to the first preferred embodiment except that the compression resistant plate 23 includes three compression resistant plate portions 232 spaced apart from each other, glued to the inner surface of the metal plate 22, and spanning the opening 211.

Figures 1, 7:
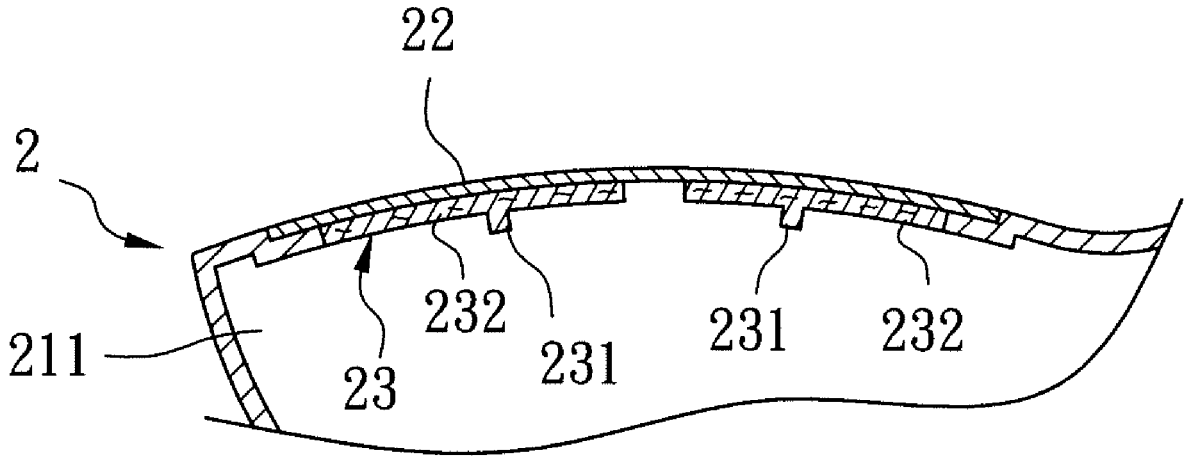
Figures 2, 7:
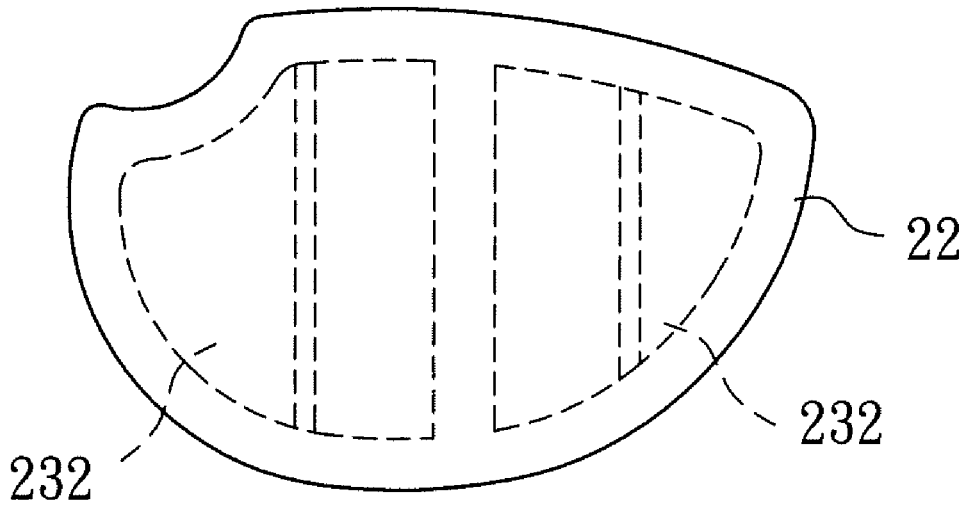

Referring to FIGS. 7-1 and 7-2, the sixth preferred embodiment of a golf club head 2 according to this invention is shown to be similar to the fourth preferred embodiment except that each of the compression resistant plate portions 232 includes a rib 231 projecting inwardly from the middle thereof. The ribs 231 are substantially parallel to each other, and span the opening 211.

Figures 1, 8:
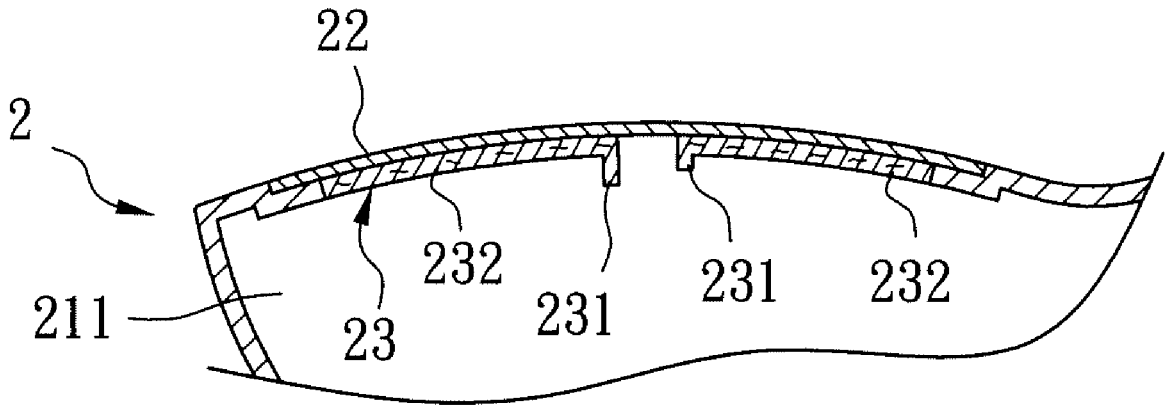
Figures 2, 8:
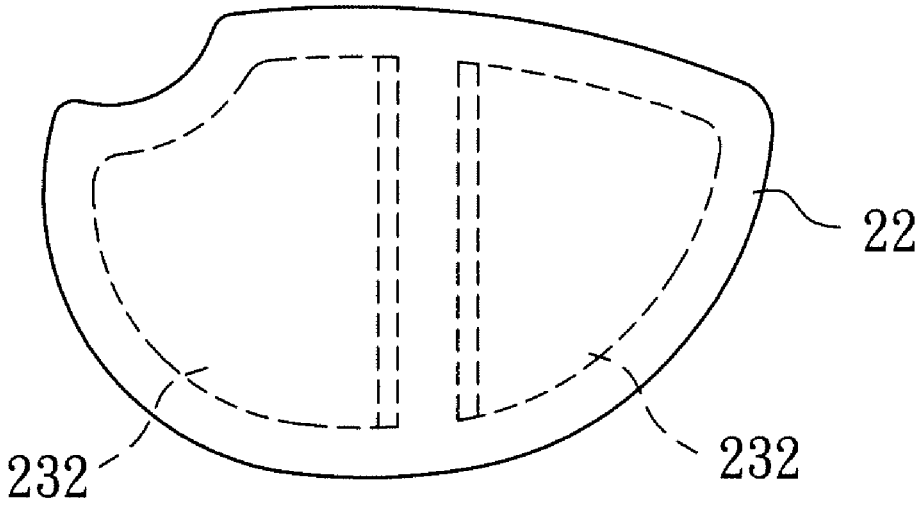

Referring to FIGS. 8-1 and 8-2, the seventh preferred embodiment of a golf club head 2 according to this invention is shown to be similar to the fourth preferred embodiment except that each of the compression resistant plate portions 232 includes a rib 231 projecting inwardly from one end thereof proximate to one end of the other of the compression resistant plate portions 232 and spanning the opening 211.

Figures 1, 9:
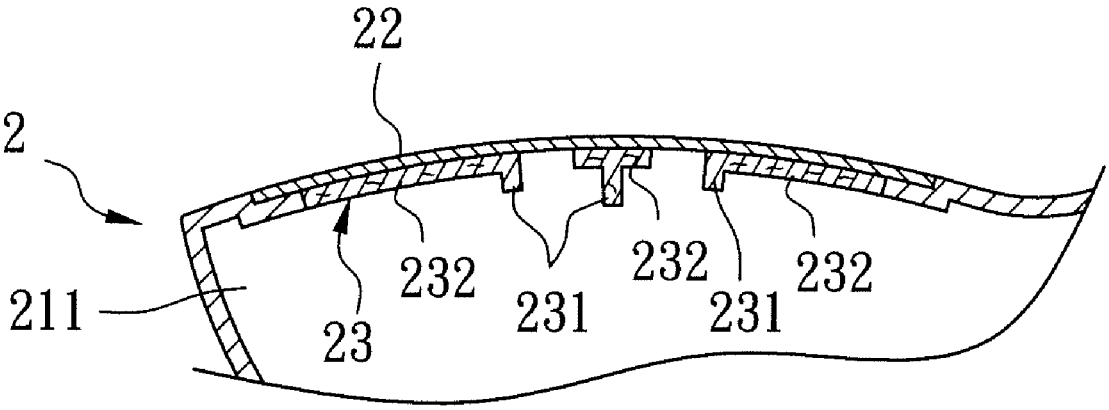
Figures 2, 9:
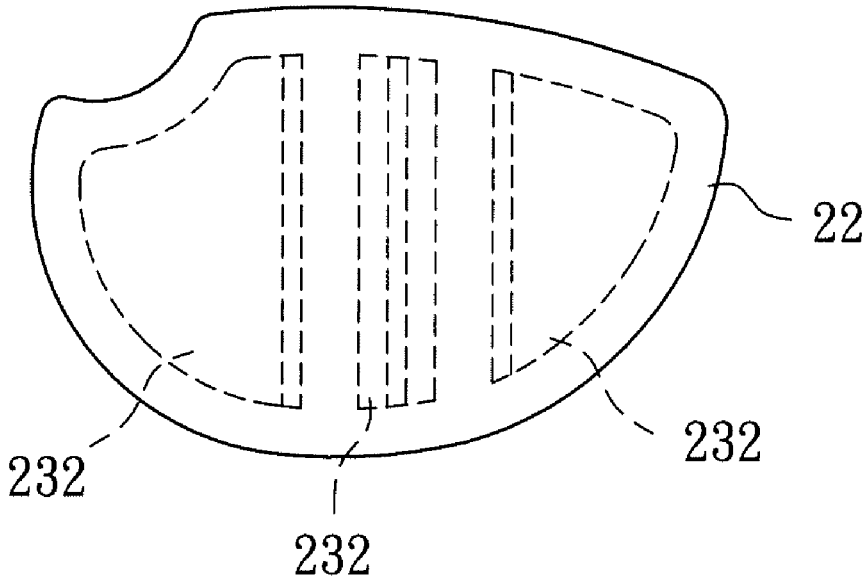

Referring to FIGS. 9-1 and 9-2, the eighth preferred embodiment of a golf club head 2 according to this invention is shown to be similar to the fifth preferred embodiment except that the middle one of the compression resistant plate portions 232 includes a rib 231 projecting inwardly from the middle thereof and spanning the opening 211, and that each of the other two of the compression resistant plate portions 232 includes a rib 231 projecting inwardly from one end thereof and spanning the opening 211.

Figures 1, 10:
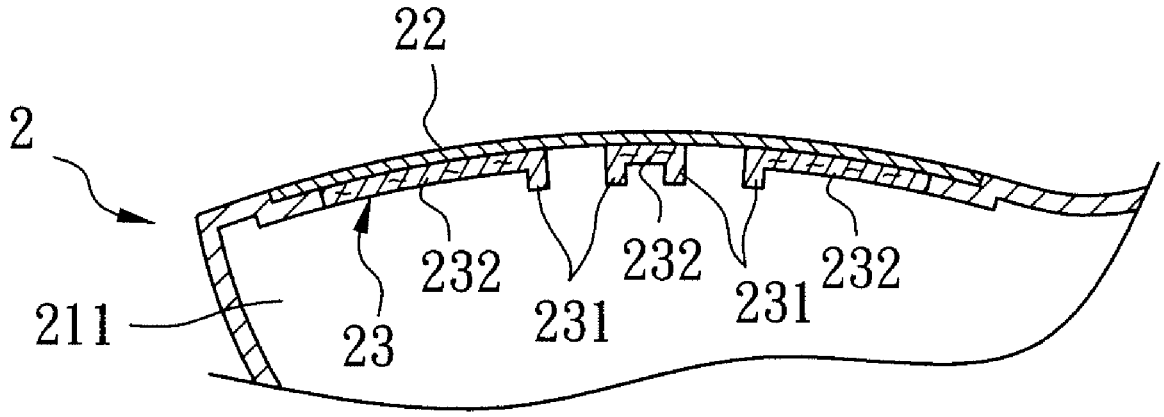
Figures 2, 10:
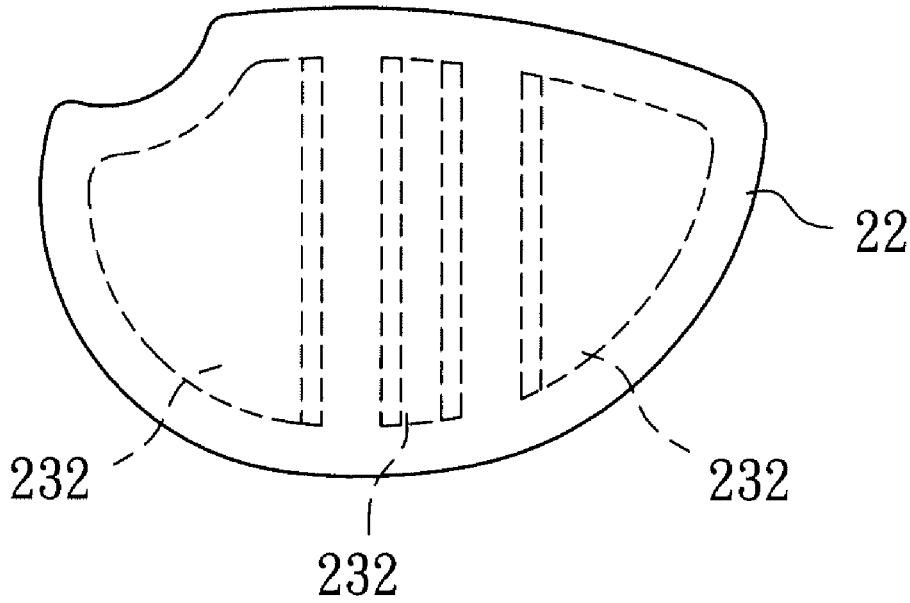

Referring to FIGS. 10-1 and 10-2, the ninth preferred embodiment of a golf club head 2 according to this invention is shown to be similar to the eighth preferred embodiment except that the middle one of the compression resistant plate portions 232 includes two ribs 231 projecting inwardly from two ends thereof, being substantially parallel to each other, and spanning the opening 211.

Figure 11:
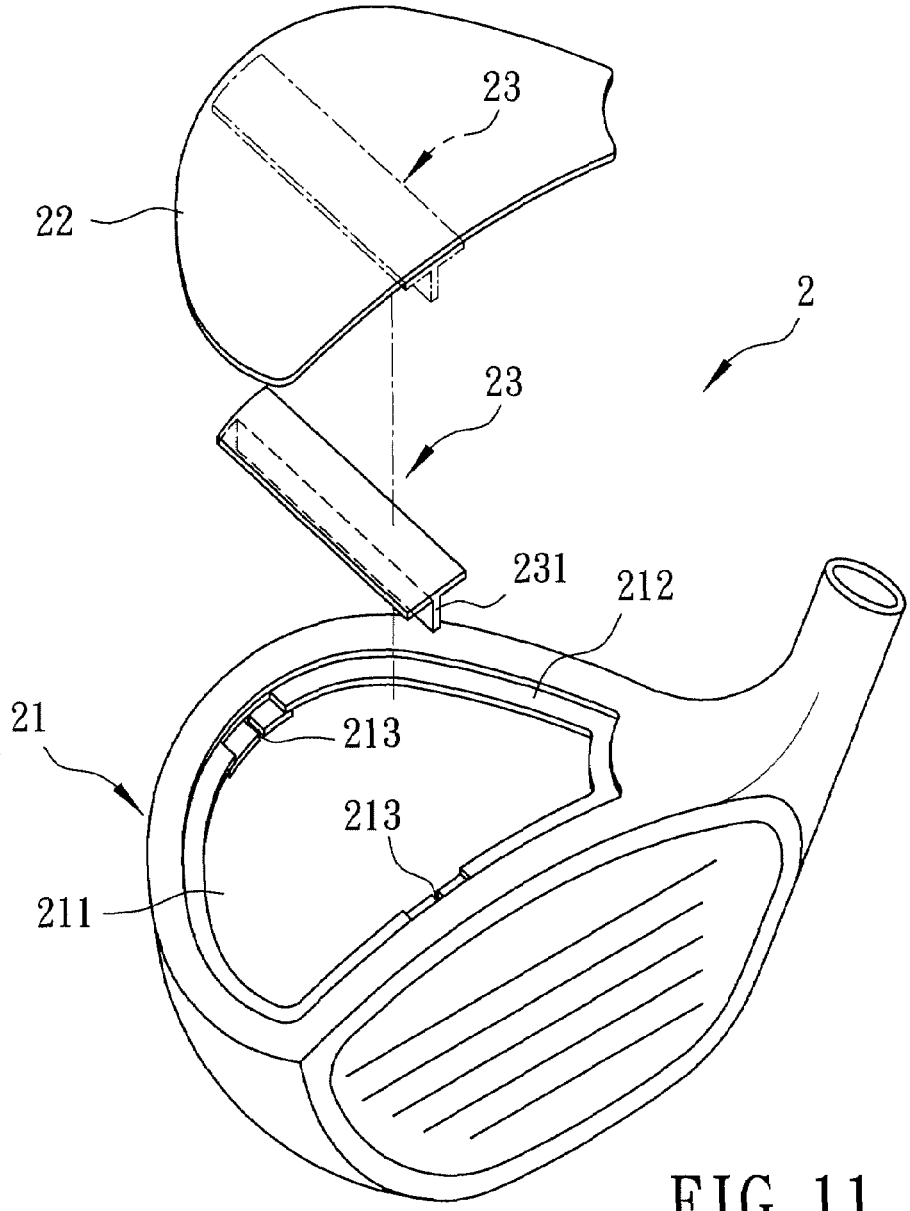
FIG. 11 is an exploded perspective view of a tenth preferred embodiment of a golf club head according to this invention.
Figure 12:
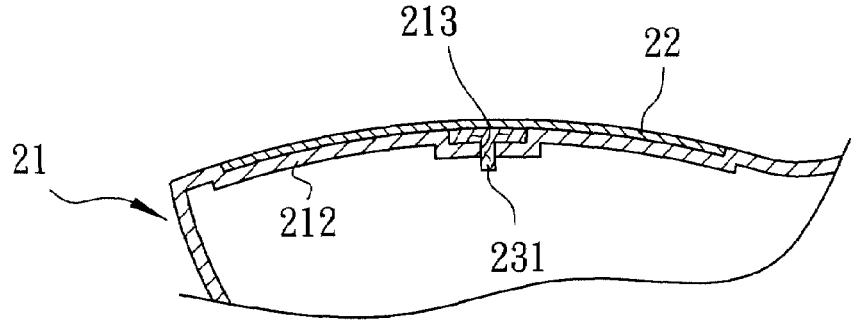
FIG. 12 is a fragmentary sectional view of the tenth preferred embodiment.

Referring to FIGS. 11 and 12, the tenth preferred embodiment of a golf club head 2 according to this invention is shown to be similar to the first preferred embodiment except that the head body 21 further includes two opposite anchoring holes 213, and that the compression resistant plate 23 includes a rib 231 projecting inwardly from the compression resistant plate 23, spanning the opening 211, and engaging the anchoring holes 213.

It should be noted that while the opening 211 is provided at the top of the hollow head body 21 in the illustrated preferred embodiments, the opening 211 can be provided at the side of the hollow head body 21 in other embodiments of this invention.

While the present invention has been described in connection with what are considered the most practical and preferred embodiments, it is understood that this invention is not limited to the disclosed embodiments but is intended to cover various arrangements included within the spirit and scope of the broadest interpretation so as to encompass all such modifications and equivalent arrangements.

We claim:

1. A golf club head comprising:

a metallic hollow head body having a front striking face, a rear side opposite to said front striking face, a top side, and an opening formed at said top side;

a metal plate formed as a separate piece from said hollow head body, said metal plate being fixed to said hollow head body and covering said opening; and a compression resistant plate glued to an inner surface of said metal plate and spanning said opening, said compression resistant plate having a specific gravity less than that of said hollow head body, whereby a center of gravity of the golf club head is lowered, wherein said compression resistant plate has a rib projecting inwardly from said compression resistant plate, spanning said opening, and extending in a front-to-rear direction.

2. The golf club head as claimed in claim 1, wherein said hollow head body includes an inner periphery that defines said opening, and that is stepped to form a shoulder formation around said opening, said metal plate being seated on and fixed to said shoulder formation.

3. The golf club head as claimed in claim 2, wherein said compression resistant plate is fitted in said opening.

4. The golf club head as claimed in claim 1, wherein said compression resistant plate is made of a material selected from the group consisting of a carbon fiber composite material, a glass fiber composite material, a boron fiber composite material, a short fiber thermoplastic composite material, a titanium fiber composite material, a titanium mesh composite material, an aluminum alloy, and a magnesium alloy.

5. The golf club head as claimed in claim 1, wherein said metal plate is made of a material selected from the group consisting of a titanium alloy, an aluminum alloy, a magnesium alloy, and a stainless steel.

6. The golf club head as claimed in claim 1, wherein said metal plate is glued to said hollow head body.

7. The golf club head as claimed in claim 1, wherein said metal plate has a thickness smaller than that of a wall of said hollow head body.

8. The golf club head as claimed in claim 1, wherein the specific gravity of said compression resistant plate is less than 2.8.

9. The golf club head as claimed in claim 1, wherein the metal plate has a thickness ranging from 0.1 to 0.5 mm.

* * * * *